US008153855B2

(12) United States Patent
Asahina et al.

(10) Patent No.: US 8,153,855 B2
(45) Date of Patent: Apr. 10, 2012

(54) BLASTING SYSTEM AND BLASTING METHOD

(75) Inventors: Kiyoshi Asahina, Kobe (JP); Masato Katayama, Kobe (JP); Ryusuke Kitamura, Kobe (JP); Joseph J. Hartvigsen, Salt Lake City, UT (US); Singaravelu Elangovan, Salt Lake City, UT (US)

(73) Assignees: Kobe Steel, Ltd., Hyogo (JP); Ceramatec, Inc., Salt Lake City, UT (US)

( * ) Notice: Subject to any disclaimer, the term of this patent is extended or adjusted under 35 U.S.C. 154(b) by 670 days.

(21) Appl. No.: 12/227,353

(22) PCT Filed: Apr. 16, 2007

(86) PCT No.: PCT/JP2007/058241

§ 371 (c)(1), (2), (4) Date: Nov. 14, 2008

(87) PCT Pub. No.: WO2007/132614

PCT Pub. Date: Nov. 22, 2007

(65) Prior Publication Data

US 2009/0131733 A1 May 21, 2009

(30) Foreign Application Priority Data

May 16, 2006 (JP) ..... 2006-136705

(51) Int. Cl.
*B09B 3/00* (2006.01)

(52) U.S. Cl. ..... 588/403; 588/900; 422/168

(58) Field of Classification Search ..... 588/403, 588/249, 261, 900; 422/168
See application file for complete search history.

(56) References Cited

U.S. PATENT DOCUMENTS

2007/0144637 A1 6/2007 Fujiwara et al.

FOREIGN PATENT DOCUMENTS

| | | |
|---|---|---|
| DE | 44 11 655 C1 | 6/1995 |
| DE | 195 08 322 A1 | 9/1996 |
| JP | 7-208899 | 1/1994 |
| JP | 7-229700 | 2/1994 |
| JP | 3354720 | 8/1994 |
| JP | 2000-266331 | 3/1999 |
| JP | 2005-207623 | 1/2004 |
| JP | 2005-214553 | 1/2004 |
| WO | WO 98/30861 | 7/1998 |

OTHER PUBLICATIONS

International Search Report dated Jul. 17, 2007 regarding PCT Application No. PCT/JP2007/058241.

EP Patent Office Extended Supplementary European Search Report for Application No./Patent No. 07741677.4 corresponding to PCT/JP2007/058241, dated Jul. 20, 2011.

*Primary Examiner* — Edward Johnson

(74) *Attorney, Agent, or Firm* — Stites & Harbison, PLLC; Juan Carlos A. Marquez, Esq

(57) ABSTRACT

The object is to rapidly clean-up an off-gas generated by blasting in a pressure vessel to such a level as to permit the exhaust of the off-gas. An object to be blasted is blasted in a pressure vessel to generate an off-gas, which is introduced into a combustion furnace to burning a combustible component contained in the off-gas. The off-gas after the burning in a reservoir section is stored in the reservoir section, and exhausted out of the reservoir section if a component contained in the off-gas complies a predetermined emission requirement, otherwise returned to at least one of the pressure vessel and the combustion furnace to be re-treated if the component does not comply the emission requirement.

9 Claims, 5 Drawing Sheets

BLASTING SYSTEM AND BLASTING METHOD

TECHNICAL FIELD

The present invention relates to a blasting system and a blasting method for blasting an object to be blasted such as an explosive object in a pressure vessel.

BACKGROUND ART

There is conventionally known a blasting method for blasting an explosive object, such as a military ammunition used for, for example, a chemical weapon or the like (e.g., a projectile mortar, a bomb, a land mine and a naval mine). Specifically, what is known as the substance includes a steel shell which accommodates a burster and a substance hazardous to a human body. An example of the hazardous substance is a chemical agent such as a mustard gas and lewisite hazardous to the human body.

The blasting method does not require disassembling for an object to be treated, and is therefore suitable for treatment for the above explosive objects. This method enables treatment for not only well-preserved ammunition but also ammunition hard to disassemble due to secular deterioration, distortion or the like. Furthermore, it is capable of decomposing almost all the hazardous substances due to an ultra-high temperature and pressure caused by an explosion. The method is disclosed, for example, in Patent Document 1.

However, this blasting method has problems to be solved as follows.

Most of the above-mentioned blasting treatment is conducted in a closed pressure vessel in view of outside-leakage prevention of a hazardous substance, or reduction in the impact of a noise, a vibration or the like caused by the blasting on surroundings. The blasting may generate an off-gas containing a combustible component such as CO, $H_2$ and $CH_4$, or a residue of the above hazardous substances. Before the off-gas is exhausted to the atmosphere, the combustible components or residual hazardous substances contained in the off-gas need to be removed (detoxified) to reference values or below. Removal of the combustible components is also necessary for blasting an explosive object without the above hazardous substances. On top of that, it is preferable to shorten the time taken for removal.

Patent Document 1: Japanese Patent Laid-Open Publication No. 7-208899

DISCLOSURE OF THE INVENTION

It is an object of the present invention to provide an art capable of rapidly depurating an off-gas generated by blasting in a pressure vessel to such a level that the off-gas is allowed to be exhausted.

As a means to the object, a blasting system according to the present invention includes: a pressure vessel for blasting inside thereof; a combustion furnace receiving an off-gas generated in the pressure vessel by the blasting and burning at least a combustible component contained in the off-gas; a reservoir section storing the off-gas after the burning in the combustion furnace; and an off-gas returning section for returning the off-gas stored in the reservoir section to at least one of the pressure vessel and the combustion furnace.

In addition, a blasting method according to the present invention includes the steps of: blasting the object to be blasted in a pressure vessel; introducing an off-gas generated by the blasting into a combustion furnace and burning a combustible component contained in the off-gas; storing the off-gas after the burning in a reservoir section; and a step in which components contained in the off-gas stored in the reservoir section is inspected and the off-gas from the reservoir section is exhausted if the components comply with a predetermined emission requirement otherwise the off-gas is returned to at least one of the pressure vessel and the combustion furnace if the component fails to comply with the emission requirement.

According to the present invention, the off-gas after the burning is once stored in the reservoir section, which enables a judgment whether the off-gas should be exhausted directly or returned for a re-treatment to the pressure vessel or the combustion furnace. Furthermore, the re-treatment makes the off-gas exhaustible and is conducted in a short time by use of existing facilities.

BEST MODE FOR IMPLEMENTING THE INVENTION

An embodiment of the present invention will be below described with reference to the drawings.

Figure 1:
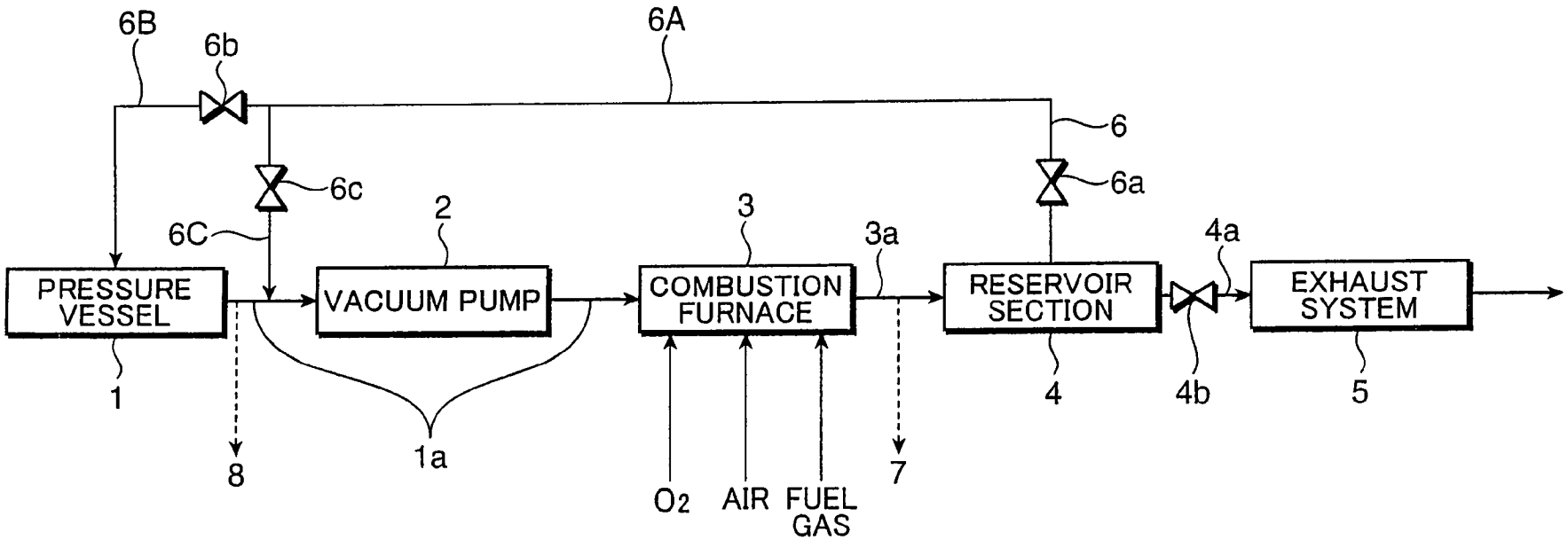
FIG. 1 is a block diagram showing a blasting system according to an embodiment of the present invention.

FIG. 1 is a block diagram showing a blasting system according to this embodiment. The blasting system includes a pressure vessel 1, a vacuum pump 2, a combustion furnace 3, a reservoir section 4, an exhaust system 5 and a return line 6. Between the pressure vessel 1 and the combustion furnace 3 is provided a line 1*a*, in which the vacuum pump 2 is arranged.

The pressure vessel 1 is for housing an object to be blasted and blasting the object to be blasted therein to generate an off-gas.

The vacuum pump 2 is for introducing the off-gas inside of the pressure vessel 1 into the combustion furnace 3, which is for burning combustible components contained in the off-gas. The combustion furnace 3 is supplied with a gas containing oxygen ($O_2$), air, a fuel gas and the like to make it possible to burn the combustible components, as well as decompose (as described later) a hazardous substance 121 which may be contained in the off-gas. The fuel gas is, for example, town gas, propane, natural gas or the like.

The reservoir section 4 is connected via a line 3*a* to the downstream side of the combustion furnace 3 to store an off-gas generated by combustion inside of the combustion furnace 3. The reservoir section 4 comprises a reservoir tank for example, and connected to the exhaust system 5 via a line 4*a*. The line 4*a* is provided midway with an on-off valve 4*b*. The exhaust system 5 exhausts the off-gas out of the system and includes a stack for example.

The reservoir section 4 is also connected to the pressure vessel 1 and the line 1*a* via the return line 6. The return line 6 is made up of a main line 6A extending from the reservoir section 4, and two branch lines 6B and 6C branching downstream from the main line 6A to be connected to the pressure vessel 1 and the line 1*a*, respectively. The lines 6A, 6B and 6C are provided with an on-off valve 6*a*, 6*b* and 6*c*, respectively.

The return line 6 allows the off-gas stored in the reservoir section 4 to return selectively to either of the pressure vessel 1 and the combustion furnace 3. In the return line 6, the main line 6A and the branch line 6B function as pressure-vessel return lines for returning the off-gas stored in the reservoir section 4 to the pressure vessel 1 while the main line 6A and the branch line 6C function as combustion-furnace return lines for returning the off-gas stored in the reservoir section 4 to the combustion furnace 3. The main line 6A is used for both the pressure-vessel return line and the combustion-furnace return line, but it is not absolutely necessary. The line 6A, for example, may be divided into the pressure-vessel return line and the combustion-furnace return line.

A part of the off-gas flowing from the combustion furnace 3 through the line 3*a* to the reservoir section 4 is extracted as a sample 7 for analysis of components contained therein. If the analysis value complies with a predetermined emission requirement (e.g., the analysis value of a specified component is equal to or below a reference value), the off-gas stored in the reservoir section 4 is directly exhausted via the exhaust system 5 to the outside. If, otherwise, the analysis value fails to comply with the emission requirement, the off-gas is returned selectively to the pressure vessel 1 or the combustion furnace 3. This selection will be described later.

Next, the blasting system and a blasting method conducted using this system will be described in detail.

Figure 2:
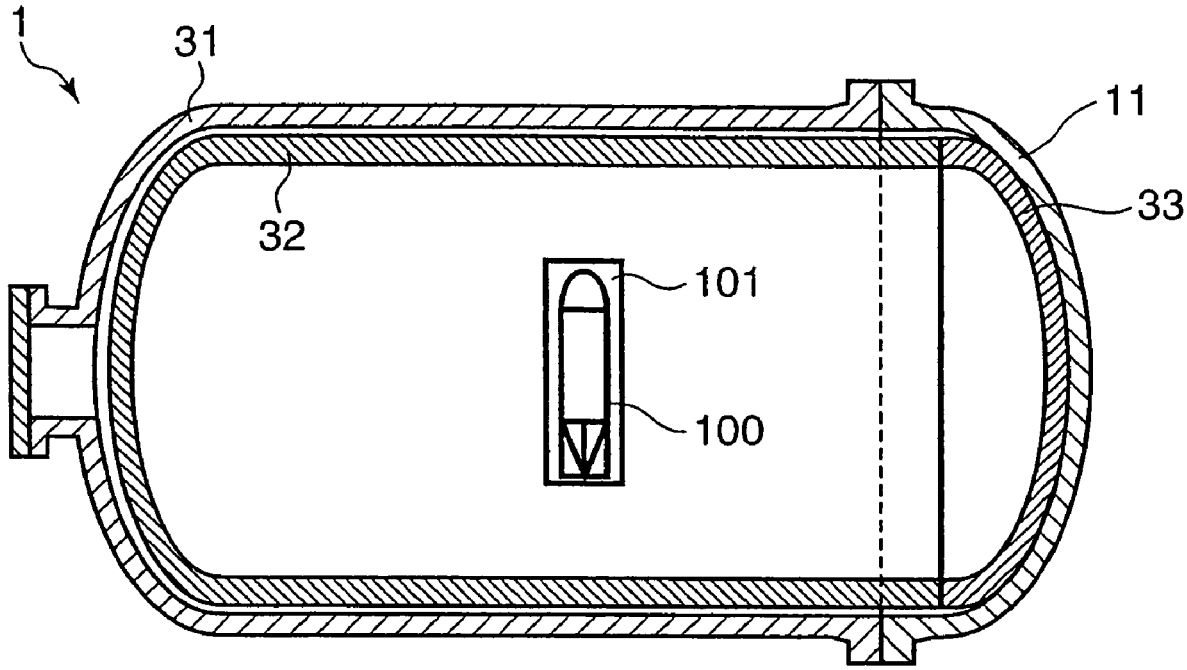
FIG. 2 is a sectional view showing a structure of a pressure vessel in the blasting system of FIG. 1.

FIG. 2 is a sectional view of the pressure vessel 1. The pressure vessel 1 has a double wall structure of an outer vessel 31 and an inner vessel 32. The outer vessel 31 is a pressure vessel made of steel or the like which is strong enough to withstand a pressure produced by a blast. The inner vessel 32 is made of a strong material such as steel capable of withstanding the impact of flying fragments by an explosion therein.

The outer vessel 31 is cylindrically formed with both ends in the axial directions: one of the ends is closed, and the other is opened and covered with a removable pressure-resistant lid 11 for opening and closing it. Similarly, the inner vessel 32 is cylindrically formed with both ends in the axial directions: one of the ends is closed, and the other is opened. The opened end faces the pressure-resistant lid 11 inside of the outer vessel 31 and is covered with a removable inner lid 33 for opening and closing it.

The inner vessel 32 is not rigidly fixed to the outer vessel 31 but loosely placed inside of the outer vessel 31, thereby allowed to make a slight relative replacement to the outer vessel 31. This loose placement of the inner vessel 32 prevents direct transmission of the impact of an explosion and the impact of a collision of scattering objects to the outer vessel 31 and also prevents application of an excessive force to the connection part (fixing part) of the inner vessel 32 to the outer vessel 31, thereby hindering damaging the connection part to improve the durability of the pressure vessel 1.

The blasting process performed in the pressure vessel 1 is a batch treatment. Specifically, it is conducted by setting an object to be blasted such as a chemical bomb into the inner vessel 32 through the opening of the vessel end formed by removing the pressure-resistant lid 11 and the inner lid 33, and blasting the object to be blasted in the inner vessel 32 after closing the opening with the lids 11 and 33.

Figure 3:
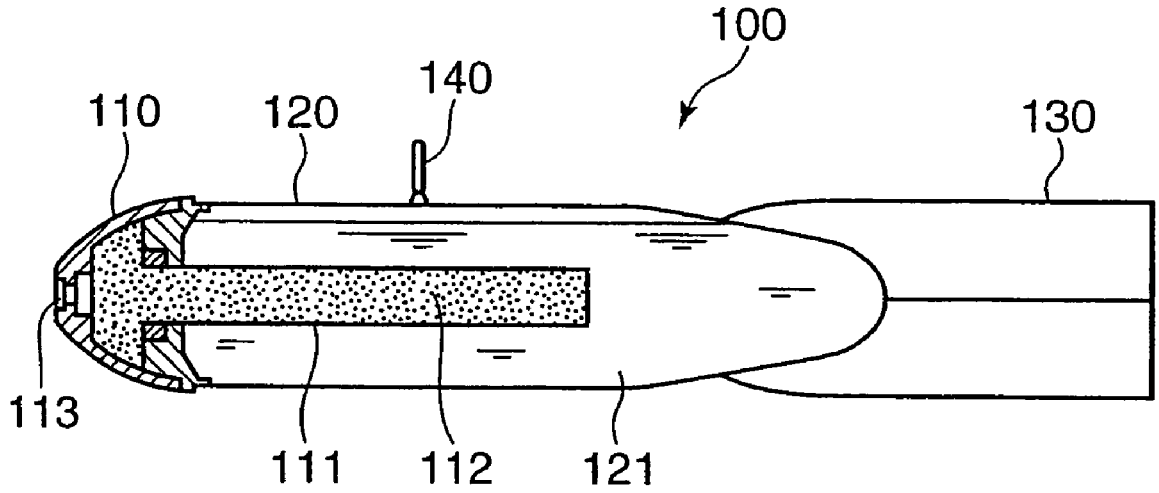
FIG. 3 is a sectional view of a chemical bomb blasted in the pressure vessel of FIG. 2.

FIG. 3 shows a chemical bomb 100 as an example of the object to be blasted. The chemical bomb 100 comprises a nose 110, a burster tube 111, a bomb shell 120 and posture controlling fins 130, and will be lifted by use of a lifting ring 140.

The burster tube 111 extends rearward from the nose 110 and is charged with a burster (explosive) 112. The nose 110 contains a fuze 113 for bursting the burster 112 in the burster tube 111.

The bomb shell 120, housing the burster tube 111, is connected to the nose 110 and filled with a hazardous substance 121. The posture controlling fins 130 are provided at the end of the bomb shell 120 opposite to the nose 110 in the axial directions to control the posture of the chemical bomb 100 while it dropping.

Used as the burster (explosive) 112 can be a military explosive such as TNT, a picric acid and RDX. The hazardous substance 121 may be, for example, blister agents such as mustard gas and lewisite, vomiting agents such as DC and DA, phosgene, sarin, a hydrocyanic acid, or the like, whether liquid or solid.

The chemical bomb 100 is blasted by use of an explosive for blasting in the pressure vessel 1 to thereby generate an off-gas containing the hazardous substance 121 and combustible components such as CO, $H_2$ and $CH_4$ in the pressure vessel 1. The off-gas is sent to the combustion furnace 3 and burned therein.

In the combustion furnace 3 is preferably performed not only burning the combustible components but also decomposing the hazardous substance 121. For this purpose is used a cold plasma furnace as the combustion furnace 3 for example. The cold plasma furnace has a mechanism for an arc-discharge treatment, and the reaction temperature therein is as low as approximately 900° C. This cold plasma furnace may be replaced, for example, with a furnace having a mechanism for retaining an off-gas for two seconds or more in a 1200° C. atmosphere, or a combustion furnace such as a high-temperature plasma furnace, which is also capable of decomposing the combustible components and a hazardous substance. Alternatively, for only the purpose of decomposing (burning) combustible components, a furnace with a simper structure can be used.

The gas generated by combustion in the combustion furnace 3 is sent through the line 3*a* to the reservoir section 4 and a part thereof is extracted as the sample 7. On the basis of the analysis result of the sample 7, it is judged whether the gas stored in the reservoir section 4 should be directly exhausted through the line 4*a* and the exhaust system 5, or returned through the return line 6 to the pressure vessel 1 or the combustion furnace 3.

In order to return the off-gas stored in the reservoir section 4 through the return line 6 to the pressure vessel 1, the vacuum pump 2 is driven under the condition that the valve 6*a* near the reservoir section 4 in the line 6A and the valve 6*b* in the line 6B are opened while the valve 6*c* in the line 6C and the valve 4*b* in the line 4*a* are closed. On the other hand, in order to return the off-gas to the combustion furnace 3, the vacuum pump 2 is driven under the condition that the valves 6*b* and 4*b* are closed and the valves 6*a* and 6*c* are opened. This means that the valves 6*a*, 6*b* and 6*c* function as a return switching means for switching the mode of the return line 6 between a mode of returning the off-gas to the pressure vessel 1 and a mode of returning it to the combustion furnace 3.

The purpose of the connection of the line 6C to the line 1*a* between the pressure vessel 1 and the vacuum pump 2 is for pressure reduction by use of the vacuum pump 2 to move the off-gas returning through the line 6C. The line 1*a* is provided with an on-off valve (not shown) upstream from the connection part of the line 1*a* and the line 6C, and the line 3*a* between the combustion furnace 3 and the reservoir section 4 is provided with an on-off valve (not shown) as well.

The off-gas returned to the pressure vessel 1 is blasted again to be decomposed in the pressure vessel 1. The decomposed off-gas is extracted as a sample 8 for analysis from the downstream side of the pressure vessel 1. The sample 8 is extracted only from the off-gas returned to the pressure vessel 1 from the reservoir section 4.

If the value obtained by analyzing the sample 8 complies with the above emission requirement (e.g., if the analysis value of a specified component is equal to or below a reference value), the off-gas is directly exhausted to the outside via the combustion furnace 3, the reservoir section 4 and the exhaust system 5. Alternatively, it may be exhausted from the downstream side of the vacuum pump 2 directly, that is, without sending the off-gas inside of the pressure vessel 1 to the combustion furnace 3 and the reservoir section 4.

Figure 4:
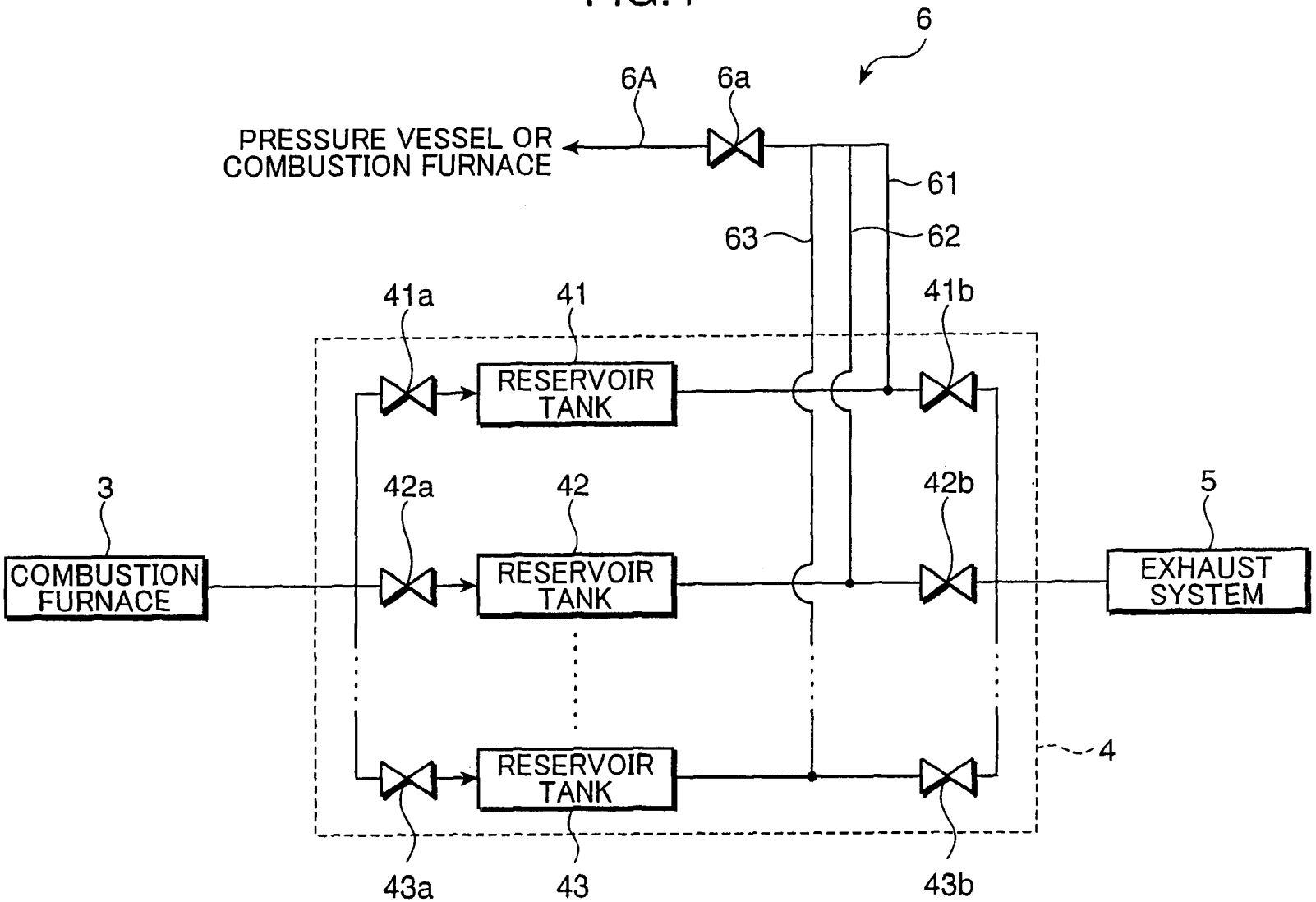
FIG. 4 is a flow sheet showing a specific configuration of a reservoir section in the blasting system of FIG. 1.

The reservoir section 4 may include, as shown in FIG. 4, a plurality of reservoir tanks 41, 42, . . . , and 43 parallel to each other. This reservoir section 4 is especially effective when the time taken to obtain the analysis value of the sample 7 after extracted is longer than the time taken for the batch treatment in the pressure vessel 1, as described later.

In addition to the reservoir tanks 41, 42, . . . , and 43, the reservoir section 4 shown in FIG. 4 includes inlet valves 41*a*, 42*a*, . . . , and 43*a* on the upstream side of the reservoir tanks 41, 42, . . . , and 43 (side of the combustion furnace 3) and outlet valves 41*b*, 42*b*, . . . , and 43*b* on the downstream side of the reservoir tanks 41, 42, . . . , and 43 (side of the exhaust system 5), respectively. The inlet valves 41*a*, 42*a*, . . . , and 43*a* and the outlet valves 41*b*, 42*b*, . . . , and 43*b* function as a tank switching means for selecting a reservoir tank to receive the off-gas out of the reservoir tanks 41, 42, . . . , and 43.

The return line 6 is connected to the downstream side of each reservoir tank 41, 42, . . . , and 43. Specifically, the upstream end of the return line 6 consists of branch lines 61, 62, . . . , and 63 branching from the main line 6A as many as the reservoir tanks. Each of the branch lines 61, 62, . . . , and 63 is connected to a piping part between the corresponding reservoir tank and the outlet valve on the downstream side thereof. The branch lines 61, 62, . . . , and 63 are not necessarily joined into the single main line 6A but may be connected mutually independently to the pressure vessel 1 or the combustion furnace 3 for example.

This reservoir section 4 achieves efficient treatment of several kinds of off-gases. For example, even if the time taken to obtain the analysis value of the sample 7 after extracted is longer than the time taken for a batch treatment in the pressure vessel 1, changing the reservoir tank used for each batch treatment in the pressure vessel 1 prevents off-gases generated in respective treatments from mixing to each other, thus enabling smooth treatment of each off-gas. In the case where the reservoir section 4 includes only one reservoir tank and the time taken to obtain the analysis value of the sample 7 after extracted is longer than the time taken for a batch treatment in the pressure vessel 1, off-gases generated in respective sequential batch treatments are all stored in the single reservoir tank to be mixed to each other in the reservoir tank. In order to avoid this mixing, the next batch treatment should wait a completion of the acquirement of the analysis value on the off-gas generated in the preceding batch treatment.

In the treatment system described above, the chemical bomb (object to be blasted) 100 is blasted in the pressure vessel 1, and the off-gas generated by the blasting is stored in the reservoir section 4 after combustion (clean-up) of the combustible components such as CO, $H_2$ and $CH_4$ or the hazardous substance 121 of the off-gas in the combustion furnace 3. The inspection, e.g. analysis, of the components contained in the off-gas after the combustion in the combustion furnace 3 enables a judgment whether the off-gas stored in the reservoir section 4 should be directly exhausted or returned to the pressure vessel 1 or the combustion furnace 3.

For example, if the analysis value of a specified component contained in the off-gas is equal to or below a reference value, the off-gas is permitted to be directly exhausted through the exhaust system 5 from the reservoir section 4. On the other hand, if the analysis value exceeds the reference value, the off-gas is not permitted to be exhausted, and returned selectively to the pressure vessel 1 or the combustion furnace 3 through the return line 6.

Which the off-gas should be returned to is decided fundamentally based on whether the off-gas can be treated again through combustion in the combustion furnace 3 or not. When the combustion in the combustion furnace 3 can reduce the specified component of the off-gas to or below the reference value, the off-gas is returned to the combustion furnace 3 to be burned again. In contrast, when the combustion in the combustion furnace 3 cannot reduce the specified component of the off-gas to the reference value or below, the off-gas is returned to the pressure vessel 1 to be exposed to a detonation again. In either case, the time for the re-treatment is so extremely short that rapid treatment is achieved, even in consideration with the time necessary for returning the off-gas.

The return line according to the present invention is not limited to the one for returning the off-gas stored in the reservoir section 4 selectively to either of the pressure vessel 1 and the combustion furnace 3. For example, the return line may be pressure-vessel return line for returning the off-gas exclusively to the pressure vessel 1, or combustion-furnace return line for returning the off-gas exclusively to the combustion furnace 3. The use of the pressure-vessel return line permits an omission of the combustion in the combustion furnace 3 after the blasting in the pressure vessel 1. Besides, the present invention is not limited to the returns frequency of the off-gas through the return line. As circumstances demand, the off-gas may be returned twice or more times to repeat the re-treatment.

The specific configuration of the reservoir section 4 is not limited to the one shown in FIG. 4. For example, if the time taken to obtain the analysis value of the sample 7 after it is extracted from the off-gas burned in the combustion furnace 3 is shorter than the time taken for the batch treatment in the pressure vessel 1, the reservoir section 4 is permitted to include only one reservoir tank with no particular problem.

Figure 5:
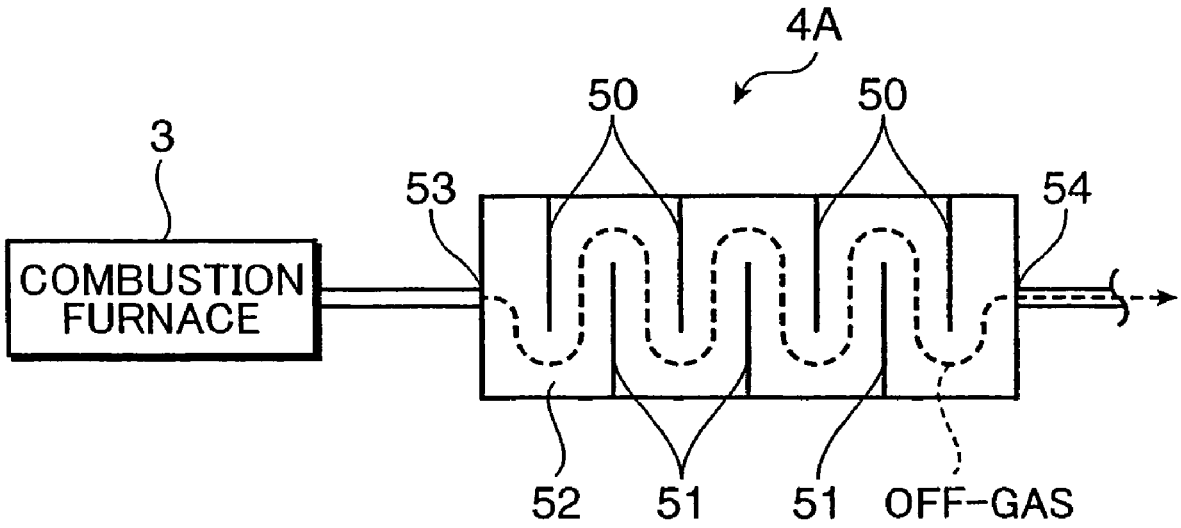
FIG. 5 is a diagram showing a configuration of a reservoir section according to the present invention.

As the reservoir tank forming the reservoir section 4, a reservoir tank 4A shown in FIG. 5 is also effective for example. The reservoir tank 4A is provided with a plurality of flow-path formation members 50 and a plurality of flow-path formation members 51 therein. The flow-path formation members 50 and 51 form a flow path 52 for making a flow of the off-gas along a predetermined locus (zigzag locus in the figure) from a gas inlet 53 up to a gas outlet 54 of the reservoir tank 4A. The flow-path formation members 50 on one side are arranged in a plurality of positions at intervals in the flowing direction of the off-gas (rightward in FIG. 5), and joined to one of the tank inner walls on both sides in the directions perpendicular to the flowing direction (up and down in FIG. 5) so as to protrude inward from the one tank inner wall. The flow-path formation members 51 on the other side protrude inward from the other of the tank inner walls on both sides in the directions perpendicular to the flowing direction, in the positions between the respective flow-path formation members 50.

The flow path 52 formed in the reservoir tank 4A is so narrow and zigzag that the off-gas introduced from the gas inlet 53 into the reservoir tank 4A is moved up to the gas outlet 54 as pushed by the following gas. This restrains an off-gas generated in a batch treatment and an off-gas generated in the succeeding batch treatment in the pressure vessel 1 from mixing to each other in the reservoir tank 4A, thereby making it possible to store both off-gases with less mixed.

In short, the reservoir tank 4A enables, by itself, several kinds of off-gases to be continuously stored and treated. For example, if the analysis value of a preceding off-gas fails to comply with a predetermined emission requirement, the preceding off-gas up to the rear end thereof mixed with the front end of the succeeding off-gas is returned to the pressure vessel 1 or the combustion furnace 3. On the other hand, if the analysis value of a preceding off-gas complies with the emission requirement, the part where the front end of the succeeding off-gas mixes with the rear end of the preceding off-gas is left in the reservoir tank 4A, while the off-gas ahead of this part, namely the preceding off-gas, is directly exhausted outside.

The object to be blasted according to the present invention is not limited to the chemical bomb 100 containing the burster (explosive) 112 and the hazardous substance 121. For example, the object to be treated may include only one or neither of the burster (explosive) 112 and the hazardous substance 121, or can also include a residue, for example, which is generated by blasting a hazardous substance such as an organic halogen placed in a container.

As described above, in the blasting system and the blasting method according to the present invention, an object to be blasted is blasted in a pressure vessel; the off-gas generated by the blasting is introduced into a combustion furnace to burn a combustible component contained in the off-gas; the off-gas after the burning is stored in a reservoir section; and components contained in the off-gas stored in the reservoir section are inspected. If the components comply with a predetermined emission requirement, the off-gas is exhausted from the reservoir section. If the components fail to comply with the emission requirement, the off-gas is returned to at least one of the pressure vessel and the combustion furnace to be re-treated. The re-treatment, performed by use of existing facilities, can depurate the off-gas to such a level that the off-gas is allowed to be exhausted.

The time taken for treating the off-gas again is short even in consideration with the time necessary for returning the off-gas, which enables rapid treatment.

More desirably, a combustible component contained in an off-gas generated by blasting an object to be blasted in the pressure vessel may be stored in the reservoir section after burned in the combustion furnace.

The off-gas may be returned selectively to the pressure vessel or the combustion furnace. In the case where the component fails to comply with the emission requirement, the off-gas stored in the reservoir tank may be returned to the combustion furnace when the component can be treated in the combustion furnace. On the other hand, In the case where the component fails to comply with the emission requirement, the off-gas stored in the reservoir tank may be returned to the pressure vessel when the component cannot be treated in the combustion furnace. Thus, efficient re-treatment of the off-gas in accordance with the component of the off-gas is achieved.

This method can be performed, for example, by the blasting system provided with the off-gas returning section including: a pressure-vessel return line for returning the off-gas stored in the reservoir section into the pressure vessel; a combustion-furnace return line for returning the off-gas stored in the reservoir section into the combustion furnace; and a return switching means for switching the mode of the off-gas returning section between a mode of returning the off-gas through the combustion-furnace return line to the combustion furnace and a mode of returning the off-gas through the pressure-vessel return line to the pressure vessel.

Moreover, even if the off-gas contains a residual hazardous substance, the off-gas containing the residual hazardous substance can be treated in the same way as the off-gas containing a combustible component.

The reservoir section according to the present invention preferably includes a plurality of reservoir tanks parallel to each other, and a tank switching means for switching to the reservoir tank for receiving the off-gas exhausted from the combustion furnace selectively out of the reservoir tanks. In the reservoir section including only one reservoir tank, an off-gas generated in a batch treatment may mix with an off-gas generated in the following batch treatment in the single reservoir tank, if the time taken to obtain the analysis value of a sample after extracted from a burned off-gas is longer than the time taken for a batch treatment in the pressure vessel. However, in the reservoir section including the plurality of reservoir tanks and the tank switching means, switching the reservoir tank used for each batch treatment prevents the mixing of the off-gases to thereby enable each off-gas to be treated without any obstacle, even if the time taken to obtain the analysis value of a sample after extracted from a burned off-gas is longer than the time taken for a batch treatment in the pressure vessel.

In addition, it is also preferable that the reservoir section includes an inlet and an outlet for the off-gas, and a flow-path formation member forming a flow path for making a flow of the off-gas in sequence along a predetermined locus from the inlet up to the outlet within the reservoir tank. The flow-path formation member specifies a flow locus of the off-gas in the reservoir section, thereby effectively preventing several kinds of off-gases from mixing to each other when the off-gases are introduced into the flow path.

The invention claimed is:

1. A blasting system for blasting an object to be blasted, comprising:

a pressure vessel for blasting inside thereof;

a combustion furnace receiving an off-gas generated in the pressure vessel by the blasting and burning at least a combustible component contained in the off-gas;

a reservoir section storing the off-gas after the burning by the combustion furnace; and an off-gas returning section for returning the off-gas stored in the reservoir section to at least one of the pressure vessel and the combustion furnace.

2. The blasting system according to claim 1, wherein the off-gas returning section includes a pressure-vessel return line for returning the off-gas stored in the reservoir section into the pressure vessel.

3. The blasting system according to claim 1, wherein the off-gas returning section includes a combustion-furnace return line for returning the off-gas stored in the reservoir section into the combustion furnace.

4. The blasting system according to claim 1, wherein the off-gas returning section includes:

a pressure-vessel return line for returning the off-gas stored in the reservoir section into the pressure vessel;

a combustion-furnace return line for returning the off-gas stored in the reservoir section into the combustion furnace; and a return switching means for switching the mode of the off-gas returning section between a mode of returning the off-gas through the combustion-furnace return line to the combustion furnace and a mode of returning the off-gas through the pressure-vessel return line to the pressure vessel.

5. The blasting system according to claim 1, wherein the reservoir section includes a plurality of reservoir tanks parallel to each other, and a tank switching means for switching selectively out of the reservoir tanks to a reservoir tank for receiving the off-gas exhausted from the combustion furnace.

6. The blasting system according to claim 1, wherein the reservoir section includes a reservoir tank having an inlet and an outlet for the off-gas, and a flow-path formation member forming a flow path for make a flow of the off-gas in sequence along a predetermined locus from the inlet up to the outlet within the reservoir tank.

7. A blasting method for blasting an object to be blasted, comprising the steps of:

blasting the object to be blasted in a pressure vessel;

introducing an off-gas generated by the blasting into a combustion furnace and burning a combustible component contained in the off-gas;

storing the off-gas after the burning in a reservoir section; and a step wherein a component contained in the off-gas stored in the reservoir section is inspected, and the off-gas is exhausted from the reservoir section if the component complies with a predetermined emission requirement and else the off-gas is returned to at least one of the pressure vessel and the combustion furnace if the component fails to comply with the emission requirement.

8. The blasting method according to claim 7, in the case where the component of the off-gas stored in the reservoir section fails to comply with the emission requirement, the off-gas is returned to the combustion furnace when the component is treatable through combustion by the combustion furnace, and else the off-gas is returned to the pressure vessel when the component is untreatable through combustion by the combustion furnace.

9. The blasting method according to claim 7, wherein a residual hazardous substance contained in the off-gas is decomposed in the step of introducing an off-gas generated by the blasting into the combustion furnace and burning a combustible component contained in the off-gas.

* * * * *